US007801472B2

(12) United States Patent
Kreiter et al.

(10) Patent No.: US 7,801,472 B2
(45) Date of Patent: Sep. 21, 2010

(54) DEVICE AND METHOD FOR PRINTING ON BOTH FACES OF A RECORDING MEDIUM, COMPRISING A CHARGE SHIFTING AND RECHARGING DEVICE

(75) Inventors: Alexander Kreiter, Wörth (DE); Stefan Scherdel, Markt Schwaben (DE); Karl Zappe, Schwindegg (DE); Manfred Viechter, Walpertskirchen (DE)

(73) Assignee: Oce Printing Systems GmbH, Poing (DE)

( * ) Notice: Subject to any disclaimer, the term of this patent is extended or adjusted under 35 U.S.C. 154(b) by 415 days.

(21) Appl. No.: 11/913,209

(22) PCT Filed: Mar. 23, 2006

(86) PCT No.: PCT/EP2006/061008

§ 371 (c)(1),
(2), (4) Date: Oct. 31, 2007

(87) PCT Pub. No.: WO2006/122847

PCT Pub. Date: Nov. 23, 2006

(65) Prior Publication Data

US 2008/0205920 A1 Aug. 28, 2008

(30) Foreign Application Priority Data

May 20, 2005 (DE) ..... 10 2005 023 462

(51) Int. Cl.
*G03G 15/20* (2006.01)

(52) U.S. Cl. ..... 399/309

(58) Field of Classification Search ..... 399/121, 399/297–302, 308, 309
See application file for complete search history.

(56) References Cited

U.S. PATENT DOCUMENTS 5,526,106 A 6/1996 Katsumi et al.
5,797,077 A * 8/1998 Samizo et al. ..... 399/309
5,946,538 A 8/1999 Takeuchi et al.

(Continued)

FOREIGN PATENT DOCUMENTS

DE 199 42 116 C2 1/2002

(Continued)

*Primary Examiner*—Hoan Tran
(74) *Attorney, Agent, or Firm*—Schiff Hardin LLP

(57) ABSTRACT

In a method or device for simultaneous double-sided printing of a recording medium, the first toner image having toner charged with a first polarity is generated on a first transfer belt and a second toner image having toner also charged with the first polarity is generated on a second transfer belt. A charge shifting device is provided along with a recharging device. At least one of the charge shifting device and the recharging device has a corotron. With the charge shifting device, the charge of the first toner image is shifted to a second polarity opposite to the first polarity and with the recharging device the second toner image with the first polarity is recharged. The recording medium is passed between the first and the second transfer belts. An electrical field is generated at a transfer printing region via which the first toner image shifted to the second polarity and the recharged second toner image are separated from the respective first or second transfer belt and are transferred to a side of the recording medium facing the respective transfer belt.

24 Claims, 2 Drawing Sheets

U.S. PATENT DOCUMENTS

| | | | | |
|---|---|---|---|---|
| 5,970,295 | A * | 10/1999 | Samizo | 399/309 |
| 6,047,156 | A * | 4/2000 | De Bock et al. | 399/298 |
| 6,097,921 | A | 8/2000 | Kageyama | |
| 6,246,856 | B1 | 6/2001 | Kopp et al. | |
| 6,556,804 | B1 | 4/2003 | Löbel et al. | |
| 7,418,227 | B2 * | 8/2008 | Omata | 399/309 |
| 2007/0189806 | A1 | 8/2007 | Lobel | |

FOREIGN PATENT DOCUMENTS

| | | |
|---|---|---|
| JP | 8-292614 | 5/1996 |
| JP | 11-231597 | 8/1999 |

* cited by examiner

DEVICE AND METHOD FOR PRINTING ON BOTH FACES OF A RECORDING MEDIUM, COMPRISING A CHARGE SHIFTING AND RECHARGING DEVICE

BACKGROUND

The present preferred embodiment concerns a device for simultaneous double-sided printing of a recording medium, with a revolving first toner image carrier and a revolving second toner image carrier; with means for generation, on the first toner image carrier, of a first toner image comprising toner that is charged with a first polarity; with a device for generation, on the second toner image carrier, of a second toner image comprising toner that is likewise charged with the first polarity; with a charge shifting device that is suitable to shift the charge of the first toner image located on the first toner image carrier to a second polarity which is opposite to the first polarity; and with a first transfer printing point at which the recording medium is passed between the first toner image carrier and the second toner image carrier and at which an electrical field can be generated via which the first toner image shifted to the second polarity and the second toner image are separated from the first or second toner image carrier and are transferred to the side of the recording medium facing the respective toner image carrier.

The preferred embodiment also concerns a printer or copier with such a device and a method for simultaneous double-sided printing of a recording medium.

A device of the aforementioned type is, for example, known from WO 98/39691 and the parallel U.S. Pat. No. 6,246,856 B1. In this known device the recording medium is formed by a paper web and the first toner image carrier and the second toner image carrier are formed by transfer belts that are arranged essentially mirror-symmetrically relative to the paper web, above and below the same. The device for generation of the first and the second toner image is formed by transfer printing points between an associated photoconductor belt and the respective transfer belt.

The known device can be operated in two different operating modes, a multi-color print collection mode and a continuous printing mode. In multi-color print collection mode toner images are successively generated on the photoconductors in primary colors or component colors (what are known as color separations) in an electrophotographic method and are successively transfer-printed onto the respective transfer belt. The individual color components are "collected" on the transfer belt, i.e. superimposed in register, such that a first color toner image results on the first transfer belt and a second color toner image results on the second transfer belt. The first transfer belt and the second transfer belt are subsequently pivoted onto the paper web in the first transfer printing region and the first toner image and the second toner image are transfer-printed onto the top or bottom of the paper web.

Only one color is printed in the continuous printing mode, meaning that no color separations are collected on the transfer belt. Instead of this, the first toner image and the second toner image are transfer-printed from the associated photoconductor onto the respective transfer belt and directly transfer-printed onto the top or bottom of the paper web at the first transfer printing point in the course of a continuous processing.

However, the first toner image carrier and the second toner image carrier do not need to be formed by an intermediate carrier; rather, they can also be formed by photoconductors, for example, in particular photoconductor belts from which transfer printing occurs directly onto a recording medium. In the present document the term "toner image carrier" is to be understood in this generality.

Various embodiments of the first transfer printing point and the charge transfer device are described in detail and their functionality is explained in EP 1 110 125 B1 (parent application), EP 1 465 023 A1 (divisional application) and the parallel application U.S. Pat. No. 6,556,804 B1. These explanations should not be repeated here, but rather are incorporated by reference into the present specification.

As is explained in the cited documents, the toner of the first toner image and the toner of the second toner image are initially charged with the same first polarity. The toner requires this charging with the first polarity for the electrophotographic process. It is typically generated via triboelectric charging in a developer station. Before the first toner image and the second toner image can be simultaneously transfer-printed onto the opposite sides of the recording medium, one of the toner images (in the present case the first toner image) must have its charge shifted. Both toner images then experience an electrical attraction force in the direction of the recording medium in a suitable electrical field provided in the transfer printing region, and via these electrical attraction force they are transfer-printed onto the recording medium.

In this known device the print result is, however, not always satisfactory. In practice a different transfer printing efficiency often results between the first toner image carrier and the one side of the recording medium and the second toner image carrier and the other side of the recording medium. The resulting print images then deviate from one another in their optical appearance. Moreover, it can lead to an alternating influencing of the two print images. For example, when a flat pattern is printed on the one side of the recording medium and isolated characters are printed on the other side, it can occur that the isolated characters appear dimly in the flat pattern.

A device for double-sided printing of a carrier material is known from the document JP 11231597 A, in which a toner image is respectively generated on a photoconductor drum and transferred to a respective transfer belt. The transfer belts contact the carrier material on opposite sides such that the toner images are transferred from the transfer belts onto the side of the carrier material contacted by the respective transfer belt. Charge corotrons are provided that recharge the toner particles of the developed toner image on the surface of the photoconductor drum. The charge of the photoconductor drum is thereby also changed such that the toner particles no longer adhere on the surface of the photoconductor drum due to their charge but rather merely due to adhesion forces. This has the result that toner particles also arrive at regions of the photoconductor that are not to be inked (and thus alter the print image), in particular in border regions of inked surfaces.

A device for double-sided printing of a carrier material is known from the document JP 08292614 A, in which a respective toner image is generated on a photoconductor drum and is transferred onto a respective transfer belt. A recharging device is respectively provided in order to recharge the toner particles of the toner images transferred from a photoconductor drum to the respective transfer belt. The transfer belts contact a carrier material to be printed on two opposite sides, such that the toner images are transfer-printed from the transfer belts onto opposite sides of the carrier material.

An arrangement for double-sided printing of a carrier material is known from the document WO 00/14607 A, in which a respective toner image is transferred from a transfer belt onto opposite sides of a carrier material to be printed. A charge shifting corotron is thereby provided in order to shift the charge of the transfer printings of a toner image to be transferred onto the carrier material.

SUMMARY

It is an object to specify a device and method in which the transfer-printing efficiencies on the two sides of the recording medium deviate less from one another and an alternating influencing of the two print images is avoided.

In a method or device for simultaneous double-sided printing of a recording medium, the first toner image comprising toner charged with a first polarity is generated on a first transfer belt and a second toner image comprising toner also charged with the first polarity is generated on a second transfer belt. A charge shifting device is provided along with a recharging device. At least one of the charge shifting device and the recharging device comprise a corotron. With the charge shifting device, the charge of the first toner image is shifted to a second polarity opposite to the first polarity and with the recharging device the second toner image with the first polarity is recharged. The recording medium is passed between the first and the second transfer belts. An electrical field is generated at a transfer printing region via which the first toner image shifted to the second polarity and the recharged second toner image are separated from the respective first or second transfer belt and are transferred to a side of the recording medium facing the respective transfer belt.

DESCRIPTION OF THE PREFERRED EMBODIMENT

Figure 1:
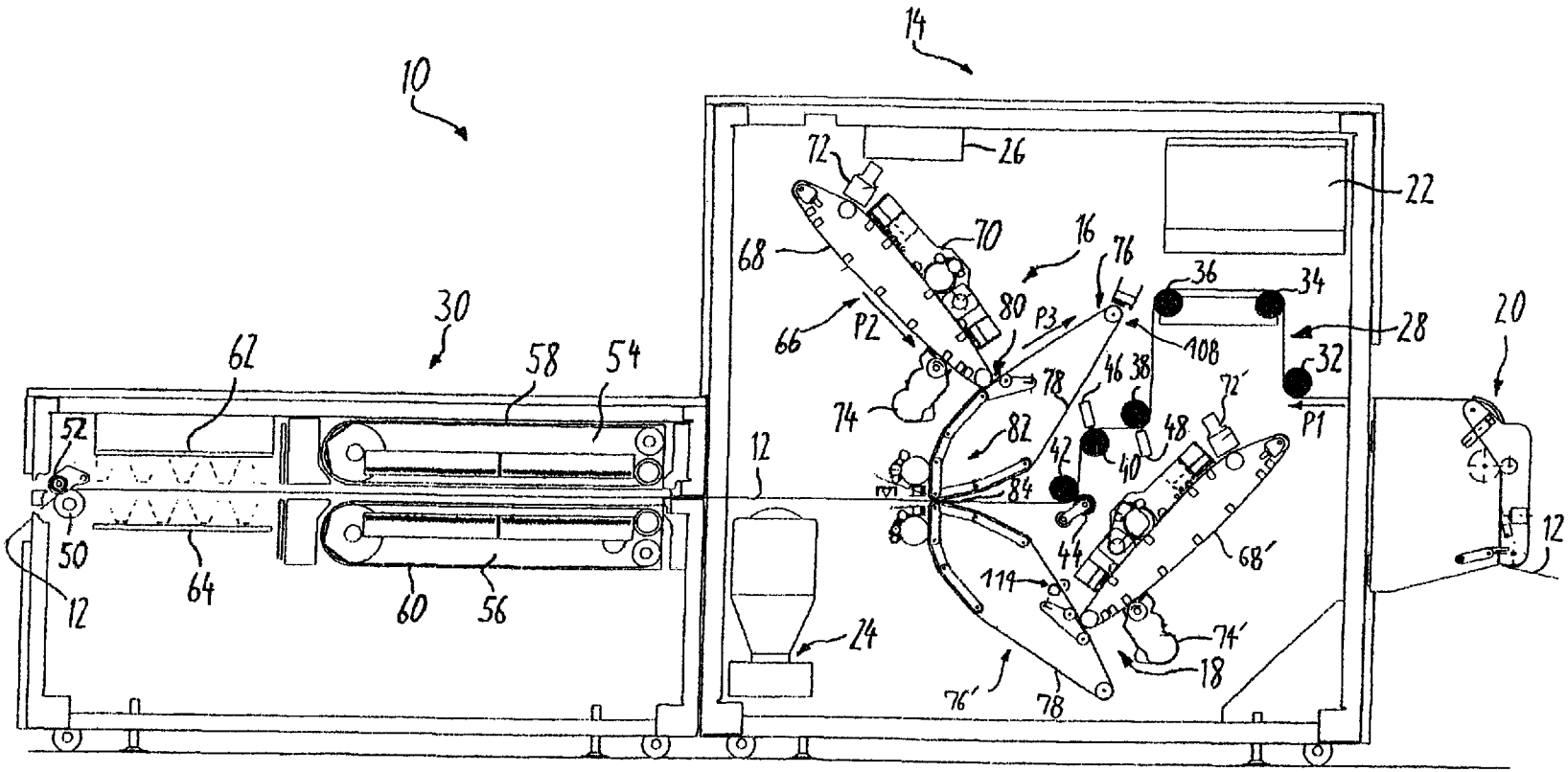
FIG. 1 is a schematic design of an electrophotographic printer with two printing units.

For the purposes of promoting an understanding of the principles of the invention, reference will now be made to the preferred embodiment and best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

According to the preferred embodiment, a recharging device is thus provided that is suitable to recharge the second toner image located on the second toner image carrier with the first polarity; i.e., the second toner image is charged with the same polarity that it already had anyway.

It has been determined that the aforementioned problems are to be ascribed to electrical and electrostatic properties of the toner of the first toner image and of the second toner image that deviate from one another. The electrostatic properties, in particular the absolute charge level, are subject to different fluctuations because the charge is produced by different processes. While the charge of the charge-shifted first toner image is essentially established by the operating parameters of the charge shifting device, the charge of the second toner image (which was triboelectrically generated) depends on, among other things, the toner throughput and atmospheric influences (such as, for example, humidity etc.). Dependent on the cited factors, under specific operating conditions the charge states of the first toner image and of the second toner image are therefore not tuned to one another, such that deviations can occur in the transfer printing efficiency and thus in the print image.

Further problems occur when the first toner image and the second toner image exhibit a significantly different height in the toner application because the electrostatic ratios thereby change in the transfer printing. A higher toner layer on one of the toner image carriers leads to an increased distance between the toner image carrier and the recording medium, whereby the capacitance of the transfer printing system is altered.

These effects, which all have an influence on the print image, cannot be accommodated solely through the voltage or the current flow in the transfer printing point and the operating parameters of the transfer printing device. Instead of these, it is inventively proposed to provide a recharging device with which the second toner image can be recharged. Via suitable selection of the operating parameters of the charge shifting device and the recharging device, the first toner image and the second toner image can be conditioned such that they are transfer-printed uniformly (i.e. with at least approximately equal transfer printing efficiency) without mutually influencing one another.

An electrophotographic high-capacity printer 10 for printing of an endless paper web 12 with a printing speed of 0.9 to 2.0 m/s is shown in FIG. 1. A printing group 14 comprises a first image generation and transfer printing unit 16 for printing of the front side of the paper web 12 as well as a second image generation and transfer printing unit 18 for printing of the back side of the paper web 12. The image generation and transfer printing units 16, 18 are designated in the following as printing units 16, 18. The first printing unit 16 is substantially structurally identical to the second printing unit 18. Identical modules in the first printing unit and the second printing unit 18 are therefore designated with the same reference characters, whereby the reference characters of the second printing unit 18 are provided with a stroke. Differences between the first printing unit 16 and the second printing unit 18 are explained further below. The printing group 14 furthermore comprises a paper feed 20, a control unit 22, a toner reservoir and preparation system 25, an image data processing unit 26 as well as a paper web drive and guidance system 28.

The paper web 12 is conveyed through the printer 10 in the direction of the arrow P1 with the aid of the paper web drive and guidance system 28, whereby after the printing in the printing group 14 the paper web 12 is fed to a fixing station 30 that fixes the toner images generated by the printing group 14 onto the paper web 12. The paper drive and guidance system 28 comprises deflection rollers 32 through 40 as well as a drive roller 42 with an opposing contact pressure roller 44. Two gap sensors 46, 48 are also provided that monitor the position of margin holes contained in the paper web 12. A further drive roller 50 and a contact pressure roller 52 for paper discharge are provided in the fixing station 30.

The first printing unit 16 and the second printing unit 18 are arranged on opposite sides of the paper web 12. The first printing unit 16 is also designated as an upper printing unit and the second printing unit 18 is also designated as a lower printing unit. The paper web 12 can be conveyed both in the direction of the arrow P1 and in the opposite direction with the aid of the drive roller 42, whereby in the following the transport of the paper web 12 in the direction of the arrow P1 is designated with a forward motion and the transport of the paper web 12 counter to the direction of the arrow P1 is designated with a backward motion. The function of the printing group 14 and of the fixing station 30 is described in detail in WO 00/34831 and DE 198 27 210 C1, which are components of the disclosure of the application by reference.

The first printing unit 16 comprises a belt drive 66 with a photoconductor belt 68, for example an organic photoconductor belt that is typically also designated as an OPC belt. The photoconductor belt 68 is driven in the direction of the arrow P2 with the aid of the belt drive 66. With the aid of a cleaning and charging unit, the photoconductor belt 68 is discharged, toner residues are removed from the photoconductor belt 68 and this is charged to a predetermined potential. With the aid of a character generator 72 that is executed as an LED character generator, regions of the uniformly charged surface of the photoconductor belt 68 are partially discharged to a lower potential or are charged to a higher potential corresponding to the signals supplied by the image data processing unit 26 (i.e. per image point), whereby a charge image is generated on the surface of the photoconductor belt 68. The charge image located on the surface of the photoconductor belt 68 comprises a latent print image. The charge image on the surface of the photoconductor belt 68 is developed (i.e. inked with toner into a toner image) with the aid of a developer unit 74.

The first printing unit 16 furthermore comprises a belt drive 76 with a transfer belt 78 that is driven in the direction of the arrow P3. The photoconductor belt 68 contacts the transfer belt 78 at a transfer printing point or location 80 (also called "second transfer printing point or location 80" in the following), meaning that the surface of the photoconductor belt 68 contacts the surface of the transfer belt 78. A toner image located on the photoconductor belt 68 is transferred onto the surface of the transfer belt 78 at the second transfer printing point 80, as is explained in detail below in connection with FIG. 2.

The transfer belt 78 is directed towards the paper web 12 and away from this in a first transfer printing region 84 with the aid of a roller device 82 whose rollers are connected with one another via levers 83, whereby the transfer belt 78 is directed towards the paper web 12 in the representation of FIG. 1. A roller device for direction of the transfer belt 78 towards the paper web 12 or movement of the transfer belt 78 away the paper web 12 is described in detail in WO 00/54266, the content of which is hereby incorporated by reference into the present specification.

In the towards state the transfer belt 78 contacts the surface of the paper web 12 on its front side, such that a toner image located on the transfer belt 78 can be transferred from the transfer belt 78 onto the front side of the paper web 12. The direction of the transfer belt 78 towards the paper web 12 is also designated as pivoting onto, and the direction of the transfer belt 78 away from the paper web 12 is also designated as pivoting away.

The transfer belts 78, 78' of the printing unit 16 and the printing unit 18 are essentially simultaneously pivoted onto the paper web 12, whereby a contact pressure is generated between two opposing rollers or roller pairs of the belt drives of the transfer belts.

The fixing station 30 comprises a first fixing unit 54 and a second fixing unit 56 that are arranged on the opposite sides of the paper web 12, whereby the first fixing unit 54 fixes the toner images on the front side of the paper web 12 and the second fixing unit 12 fixes the toner images on the back side of the paper web 12. The fixing units 54, 56 are executed as radiation fixing units, whereby the fixing units 54, 56 respectively comprise a cover device 58, 60 that covers the heat radiators of the fixing units 54, 56 during operating states in which no fixing of the print images on the paper web 12 should occur. Viewed in the transport direction of the paper web 12, cooling elements 62, 64 are arranged after the fixing units 54, 56, which cooling elements 62, 64 cool the paper web 12 before the exit from the fixing station 30 in order to prevent a damaging of the paper web 12, in particular as a result of too-low paper moisture.

Figure 2:
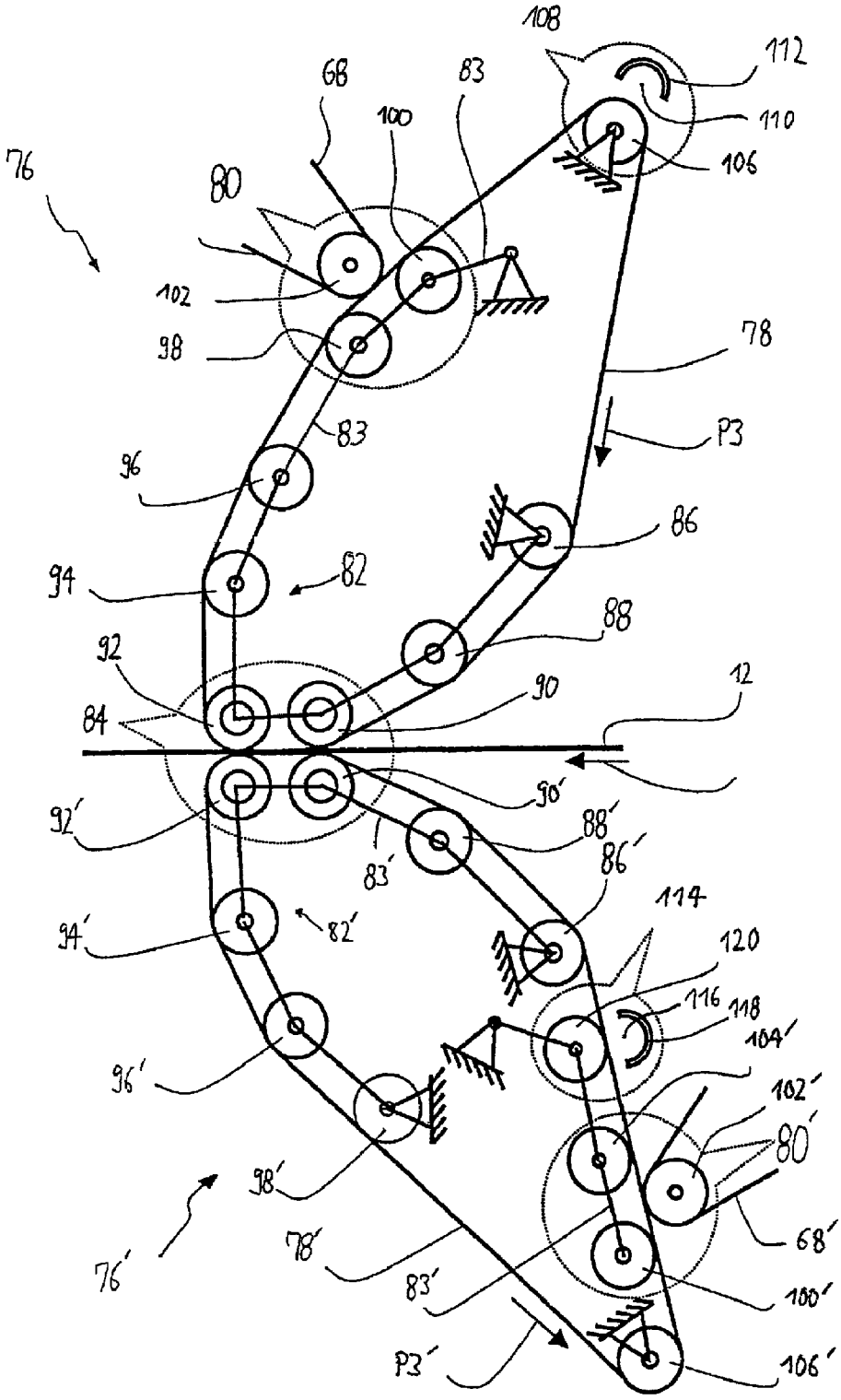
FIG. 2 is a schematic representation of the two transfer belt drives from FIG. 1.

An enlarged section from FIG. 1 is schematically presented in FIG. 2. Shown therein are the transfer belt belt drive 76 of the first printing unit 16 with the transfer belt 78 (called the first transfer belt 78 in the following) as well as the transfer belt belt drive 76' of the second printing unit 18 with the associated transfer belt 78' (called the second transfer belt 78' in the following). Also shown is a segment of the first photoconductor belt 68 which adjoins the first transfer belt 78 at the aforementioned second transfer printing location 80. A segment of the second photoconductor belt 68' which adjoins the second transfer belt 78' at a third transfer printing location 80' is likewise shown in the segment of the second photoconductor belt 68'.

As is shown in FIG. 2, the first roller device 82 comprises rollers 86, 88, 90, 92, 94, 96, 98 and 100 which are connected via levers 83. The second roller device 82' comprises rollers 86', 88', 90', 92', 94', 96' and 98'.

A further roller 102 around which the first photoconductor belt 68 is directed is arranged at the second transfer printing location 80 such that it brings the first photoconductor belt 68 into contact with a segment of the first transfer belt 78 which extends between the rollers 98 and 100. In a similar manner, a roller 102' around which the second photoconductor belt 68' is directed is arranged at the third transfer printing location 80' such that it brings the second photoconductor belt 68' into contact with a segment of the transfer belt 78' which extends between the rollers 100' and 104'. Finally, a first drive roller 106 is provided to drive the first transfer belt 78 and a second drive roller 106' is provided to drive the second transfer belt 78'.

As was already mentioned above, the first belt drive 76 and the second belt drive 76' are designed essentially mirror-symmetrical relative to the paper web 12. A deviation of the mirror symmetry exists in the arrangement of the second transfer printing location 80 on the one side and the third transfer printing location 80' on the other side, which is only to be ascribed to an appropriate arrangement of the first photoconductor belt drive 66 and the second photoconductor belt drive 66' in the printer 10, however (see FIG. 1).

Also found deviating from the mirror symmetry in the first transfer belt belt drive 76 is a charge shifting device 108 that, in addition to the aforementioned drive roller 106, comprises an alternating current corotron with a corona wire 110 and a shield 112. The charge shifting device 108 serves to shift the charge of a first toner image located on the first transfer belt 78.

Provided in the second transfer belt belt drive 76' is a recharging device 114 that comprises an alternating current corotron with a corona wire 116 and a shield 118 as well as a roller 120 which serves as an antipole to the shield 118. The recharging device 114 serves to recharge a second toner image (located on the second transfer belt 78') with the same polarity.

The mode of operation of the printing group 14 is described in the following.

Charge images are generated on the photoconductor belts 68 and 68' with the aid of the character generators 72 and 72'. These charge images are developed with toner in a known manner by the developer stations 74 or 74' in order to generate a first toner image on the first photoconductor belt 78 and a second toner image on the photoconductor belt 78'. The first toner image and the second toner image comprise toner particles that are charged with a first polarity. The charging of the toner with the first polarity occurs triboelectrically in the developer stations 74 and 74'. In the shown exemplary embodiment the first polarity is negative.

At the second transfer printing location 80 the first toner image is transfer-printed from the first photoconductor belt 68 onto the first transfer belt 78. The transfer printing occurs on the one hand via the contact between the first photoconductor belt 68 and the first transfer belt 78, and on the other hand via an electrical field that exists between the roller 102 on the one side and the rollers 98 and 100. The rollers 98 and 100 are at ground potential, and an electrostatic potential that exhibits a second polarity opposite to the first polarity is applied at the roller 102. The resulting electrical field is directed such that the toner is transferred from the first photoconductor belt 68 to the first transfer belt 78. The transfer printing occurs in the same manner at the third transfer printing location 80'.

After the transfer printing a first toner image that is charged with the first polarity (here negative) is located on the first transfer belt 78 and a second toner image which likewise is charged with the first polarity (here negative) is located on the second transfer belt 78'.

The first transfer belt 78 is moved in the direction of the arrow P3 such that the first toner image is moved through the charge shifting device 108 (see FIG. 2). An alternating voltage of 8 to 20 $kV_{pp}$ (measured from peak to peak) with a frequency of 2 to 20 kHz is thereby applied at the corona wire 110. The transport roller 106 is at ground potential while a direct voltage with a magnitude of 0.1 to 5 kV and a second polarity that is opposite the first polarity is applied at the shield 112. The first toner image is thereby shifted from the first polarity to the second polarity. A current of 100 to 1200 μA thereby flows across the shield 112. The shield current is advantageously regulated to a desired value that lies in the cited range.

The second toner image is moved onto the second transfer belt 78' via the recharging device 114 in which it is recharged (i.e. charged with the same polarity that it already has anyway). Apart from the polarities of the shield 118 and the roller 120, the recharging device 114 is designed just like the charge shifting device 108. In the shown exemplary embodiment, in the recharging device 114 the roller 120 is located at ground potential while a direct voltage with the first polarity is applied to the shield 118. The voltage ranges of the direct voltage and alternating voltage and the range of the shield current in the recharging device 114 correspond in terms of magnitude to those of the charge shifting device. The shield current of the recharging device 114 is advantageously likewise regulated to a desired value. In the shown embodiment the desired values of the shield currents coincide in terms of magnitude in the charge shifting device 108 and the recharging device 114.

The direct voltage and the alternating voltage at the charge shifting device 108 and the recharging device 114 are selected such that the shifted first toner image and the recharged second toner image have the same electrostatic properties, apart from their polarity.

The shifted first toner image and the recharged second toner image are then conveyed into the first transfer printing region 84 on their respective transfer belts 78 or 78'. In the depiction of FIG. 2, the roller device 82 and the roller device 82' are pivoted towards the paper web 12 such that the first transfer belt 78 with the first toner image located thereupon, the paper web 12 and the second transfer belt 78' with the second toner image located thereupon are pressed against one another between the rollers 90 and 92 on the one hand and 90' and 92' on the other hand in the transfer printing region 84.

At the same time a direct voltage is applied between the upper roller pair 90, 92 on the one hand and the lower roller pair 90', 92' on the other hand, which direct voltage generates an electrical field for transfer printing of the first and second toner images onto the paper web 12. The electrical field between the upper roller pair 90, 92 and the lower roller pair 90', 92' is developed such that (in the depiction from FIG. 2) the first toner image that is shifted to the second polarization experiences an electrostatic force downwards and is transfer-printed onto the top of the paper web 12 while the second toner image, which was triboelectrically charged with the first polarity and was recharged with the first polarity, experiences an electrostatic force upwards and thus is transfer-printed from the second transfer belt 78' onto the bottom of the paper web 12.

The details of the first transfer printing point 84 are described in EP 1 110 125 B1, EP 1 465 023 A1 and the corresponding U.S. Pat. No. 6,556,804 B1, in particular in FIGS. 9 through 11 contained therein. The specifications contained therein of the various designs of a transfer printing point between two transfer belts and a carrier material are herewith incorporated by reference into the present specification.

For the functioning of the double-sided simultaneous transfer printing at the first transfer printing point 84 it is necessary that the first toner image and the second toner image are loaded with different polarities so that they can be transfer-printed in different directions (namely the first toner image from the first transfer belt 78 downwards and the second toner image from the second transfer belt 78' upwards) with the same electrical field. For this reason a charge shifting device corresponding to the charge shifting device 108 of FIGS. 1 and 2 (however not the recharging device 114) was already provided in the devices from the documents EP 1 110 125 B1, EP 1 465 023 A1 and U.S. Pat. No. 6,556,804 B1.

As was already mentioned in the specification preamble, in this prior art without recharging device 114 the problem arises that the print images on the top and on the bottom of the paper web 12 sometimes turn out differently. The transfer printing efficiencies on the different sides of the paper web 12 often differ from one another. It can also lead to an alternating influencing of the two print images, for example when a flat inked print image is printed on the one paper side and, for example, only isolated characters or lines are printed on the other side. In this case it could happen that the characters or lines of the second paper side would be dimly recognizable in the flat print image on the first paper web side.

This problem could not be satisfactorily solved solely via an adjustment of the transfer printing current at the transfer printing station 84 and an adjustment of the charge shifting voltage at the charge shifting device. In particular, the charge shifting voltage of the charge shifting device 108 cannot be selected too low, since otherwise very small characters or details in the print image could possibly be lost when the charge of the associated toner was not sufficiently shifted. However, if the charge shifting voltage is selected such that no detail in the first print image can be lost, in the prior art the shifted first toner image is for the most part charged more strongly, seen absolutely, than the second toner image whose toner was merely triboelectrically charged. In the prior art deviations in the transfer printing efficiency can thus occur between the two toner images.

A further cause for a non-uniform transfer printing on the top and the bottom of the paper web exists in the prior art such that the triboelectrical charge of the toner (and thus the charge of the second toner image) is dependent on the one hand on the atmospheric conditions (humidity etc.), on the other hand on the toner throughput. The degree of charge of the second toner image is thus subject to fluctuations. The electrical and electrostatic properties of the print image also change dependent on the level of the toner application because the distance between the transfer belt and the paper web (and thus the capacitance of the transfer printing system) is thereby altered.

The properties of the toner of the first print image and of the second print image can be conditioned (i.e. adapted to one another in the manner that a more uniform transfer printing is achieved without interaction between the two print images) via the use of two charging devices, namely the charge shifting device 108 on the one hand and the recharging device 114 on the other hand. The print quality on both paper sides is thereby identical and in fact is largely independent of the electrostatic properties of the toner, the level of the toner application and the toner throughput. The use of a charge shifting device 108 in combination with a recharging device 114 allows identical transfer printing efficiencies to be achieved in both printing groups 16 and 18.

In the shown embodiment both the charge shifting device 108 and the recharging device 114 comprise both an alternating current corotron with a corona wire 110 or 116, a shield 112 or 118 at which a direct voltage is applied as well as an antipole element which is formed by rollers 106 or 120. Instead of the rollers 106 and 120, other antipole elements can also be used, for example an abrading object such as a brush or a plate or an element which does not contact the transfer belt 78 or 78' (such as, for example, a blade element or a further corotron).

Preferred combinations of polarization states of the shield 112, the roller 106, the shield 116 and the roller 120 are comprised in the following table, whereby the combination Nr. 1 contained therein was already described above.

| Combination Nr. | Shield 112 | Roller 106 | Shield 118 | Roller 120 |
|---|---|---|---|---|
| 1 | Second polarity | Ground potential | First polarity | Ground potential |
| 2 | Second polarity | Ground potential | Ground potential | Second polarity |
| 3 | Ground potential | First polarity | First polarity | Ground potential |
| 4 | Ground potential | First polarity | Ground potential | Second polarity |

The arrangement of the charge shifting device 108 and the recharging device 114 can deviate from that of FIG. 2 as long as they are respectively arranged between the second transfer printing location 80 and the first transfer printing point 84 or between the third transfer printing point 80' and the first transfer printing location 84 as considered in the revolution direction of the respective transfer belt 78 or 78'.

Naturally, the charge shifting device 108 can also be arranged in the second or lower printing group 18 and the recharging device 114 can be arranged in the first or upper printing group 16.

Differently than is presented in FIG. 1, instead of the developer station 74 or 74' a plurality of developer stations with differently colored toner can be arranged on the photoconductor belt 66 or 66'. Different color components of a color image (what are known as color separations) can then be successively generated on the photoconductor belt 68 or 68' and be superimposed in register on the transfer belt 78 or 78'. The transfer belt belt drives 76 and 76' are thereby found in a collection mode in which the transfer belts 78 and 78' are pivoted away from the paper web 12 by the roller devices 82 and 82'. Only when all color separations are superimposed are the transfer belts 78 or 78' pivoted onto the paper web 12; the charge of the collected image on the first transfer belt 78 is shifted by the charge shifting device 108, the color image on the second transfer belt 78' is recharged by the recharge device 114; and the two collected images so conditioned are simultaneously transfer-printed onto the respective side of the paper web 12 at the transfer printing point 84 as described above.

Although a preferred exemplary embodiment has been shown and described in detail in the drawings and in the preceding specification, it should merely be viewed as purely exemplary and not as limiting the invention. It is noted that only the preferred exemplary embodiment is presented and described, and all variations and modifications that presently and in the future lie within the protective scope of the invention should be protected.

We claim as our invention:

1. A device for simultaneous double-sided printing of a recording medium, comprising:

a revolving first transfer belt and a revolving second transfer belt;

a first toner image generator generating on the first transfer belt a first toner image comprising toner that is charged with a first polarity;

a second toner image generator generating on the second transfer belt a second toner image comprising toner that is also charged with the first polarity;

a charge shifting device which shifts the charge of the first toner image located on the first transfer belt to a second polarity which is opposite to the first polarity;

a transfer printing region at which the recording medium is passed between the fist transfer belt and the second transfer belt and at which an electrical field is generated via which the first toner image shifted to the second polarity and the second toner image are separated from the first or second transfer belt respectively and are transferred to a respective side of the recording medium facing the respective transfer belt;

a recharging device to recharge the second toner image located on the second transfer belt with the first polarity; and at least one of the charge shifting device and the recharging device comprising a corotron, an antipole element situated opposite the corotron at an opposite side of the transfer belt facing away from the corotron and forming an electrical antipole relative to a charge of the corotron, the antipole element being in contact with said opposite side of the transfer belt, and the corotron comprising at least one corona wire at which an alternating voltage is applied and a shield at which a direct voltage is applied.

2. A device according to claim 1 in which at least one of the first toner image generator and the second toner image generator are formed by a respective first transfer printing location or second transfer printing location at which the first or second toner image is transfer-printed from a respective first photoconductor or a second photoconductor onto the respective first or second transfer belt.

3. A device according to claim 2 in which the at least one of the first photoconductor and the second photoconductor are formed by a photoconductor belt.

4. A device according to claim 1 in which the antipole element is formed by a roller, a brush, or a plate.

5. A device according to claim 1 in which an alternating voltage of 8 to 20 $kV_{pp}$ measured from peak to peak is applied to the at least one corona wire.

6. A device according to claim 1 in which an alternating voltage with a frequency of 2 to 20 kHz is applied to the at least one corona wire.

7. A device according to claim 1 in which a voltage with a magnitude of 0.1 to 5 kV is applied between the shield and the antipole element.

8. A device according to claim 1 in which a current from 100 to 1200 μA flows across the shield.

9. A device according to claim 1 in which the shield of the corotron of the charge shifting device is charged with the second polarity, the antipole element of the charge shifting device lies at ground potential, the shield of the corotron of the recharging device is charged with the first polarity, and the antipole element of the recharging device lies at ground potential.

10. A device according to claim 1 in which the shield of the corotron of the charge shifting device is charged with the second polarity, the antipole element of the charge shifting device lies at ground potential, the shield of the corotron of the recharging device lies at ground potential, and the antipole element of the recharging device is charged with the second polarity.

11. A device according to claim 1 in which the shield of the corotron of the charge shifting device lies at ground potential, the antipole element of the charge shifting device is charged with the first polarity, the shield of the corotron of the recharging device is charged with the first polarity, and the antipole element of the recharging device lies at ground potential.

12. A device according to claim 1 in which the shield of the corotron of the charge shifting device lies at ground potential, the antipole element of the charge shifting device is charged with the first polarity, the shield of the corotron of the recharging device lies at the ground potential, and the antipole element of the recharging device is charged with the second polarity.

13. A device according to claim 1 whereby the first polarity is negative and the second polarity is positive.

14. A device for simultaneous double-sided printing of a recording medium, comprising:

a revolving first transfer belt and a revolving second transfer belt;

a first toner image generator generating on the first transfer belt a first toner image comprising toner that is charged with a first polarity;

a second toner image generator generating on the second transfer belt a second toner image comprising toner that is also charged with the first polarity;

a charge shifting device which shifts the charge of the first toner image located on the first transfer to a second polarity which is opposite to the first polarity;

a transfer printing region at which the recording medium is passed between the first transfer belt and the second transfer belt and at which an electrical field is generated via which the first toner image shifted to the second polarity and the second toner image are separated from the first or second transfer belt respectively and are transferred to a respective side of the recording medium facing the respective transfer belt;

a recharging device to recharge the second toner image located on the second transfer belt with the first polarity; and the charge shifting device and the recharging device comprising a corotron, an antipole element situated opposite the corotron at an opposite side of the transfer belt facing away from the corotron and forming an electrical antipole relative to a charge of the corotron, the antipole element being in contact with said opposite side of the transfer belt, and the corotron comprising at least one corona wire at which an alternating voltage is applied and a shield at which a direct voltage is applied.

15. A method for simultaneous double-sided printing of a recording medium, comprising the steps of:

generating a first toner image comprising toner charged with a first polarity on a first transfer belt, and generating a second toner image comprising toner also charged with the first polarity on a second transfer belt;

providing a charge shifting device and a recharging device, at least one of which comprises a corotron at one side of the respective transfer belt, an antipole element situated opposite the corotron on the other side of the respective transfer belt and forming an electrical antipole relative to a charge of the corotron, the antipole element being in contact with a side of the transfer belt facing away from the corotron, and the corotron comprising at lest one corona wire at which an alternating voltage is applied and a shield at which a direct voltage is applied;

with the charge shifting device, shifting the charge of the first toner image located on the first transfer belt to a second polarity which is opposite to the first polarity, and with the recharging device, recharging the second toner image located on the second transfer belt with the first polarity; and passing the recoding medium between the first transfer belt and the second transfer belt at a transfer printing region, and generating an electrical field at the transfer printing region via which the first toner image shifted to the second polarity and the recharged second toner image are separated from the respective first or second transfer belt and are transferred to a side of the recording medium facing the respective transfer belt.

16. A method according to claim 15 in which at least one of the first toner image and the second toner image is transfer-printed from a respective first or second photoconductor onto the respective first or second transfer belt at a respective first or second transfer printing location.

17. A method according to claim 16 in which at least one of the first photoconductor and the second photoconductor are formed by a photoconductor belt.

18. A method according to claim 17 in which respective two rollers via which the respective first and second belts are directed are arranged next to one another at the respective first and second transfer printing locations, and an electrostatic potential that exhibits in total the second polarity is applied to the respective rollers; and in which a respective roller around which the respective first or second photoconductor belts is directed is arranged such that it brings the respective first or second photoconductor belt into contact with a segment of the respective first or second transfer belt which extends between the respective two rollers.

19. A method according to claim 15 in which the antipole element is formed by a respective roller, a brush or a plate.

20. A method according to claim 15 in which an alternating voltage of 8 to 20 $kV_{pp}$ measured from peak to peak is applied to the at least one respective corona wire.

21. A method according to claim 15 in which an alternating voltage with a frequency of 2 to 20 kHz is applied to the at least one respective corona wire.

22. A method according to claim 15 in which a voltage with a magnitude of 0.1 to 5 kV is applied between the respective shield and the respective antipole element.

23. A method according to claim 15 in which a current from 100 to 1200 μA flows across the respective shield.

24. A method for simultaneous double-sided printing of a recording medium, comprising the steps of:

generating a first toner image comprising toner charged with a first polarity on a first transfer belt, and generating a second toner image comprising toner also charged with the first polarity on a second transfer belt;

providing a charge shifting device and a recharging device each comprising a corotron at one side of the respective transfer belt, an antipole element situated opposite the corotron on the other side of the respective transfer belt and forming an electrical antipole relative to a charge of the corotron, the antipole element being in contact with a side of the transfer belt facing away from the corotron, the corotron comprising at least one corona wire at which an alternating voltage is applied and a shield at which a direct voltage is applied;

with the charge shifting device, shifting the charge of the first toner image located on the first transfer belt to a second polarity which is opposite to the first polarity, and with the recharging device recharging the second toner image located on the second transfer belt with the first polarity; and passing the recording medium between the first transfer belt and the second transfer belt at a transfer printing region, and generating an electrical field at the transfer printing region via which the first toner image shifted to the second polarity and the recharged second toner image are separated from the respective first or second transfer belt and are transferred to a side of the recording medium facing the respective transfer belt.

* * * * *